US011707649B2

(12) United States Patent
Osborne

(10) Patent No.: US 11,707,649 B2
(45) Date of Patent: Jul. 25, 2023

(54) PORTABLE GOLF BALL SCRUBBER ASSEMBLY

(71) Applicant: Kevin Osborne, Filer, ID (US)

(72) Inventor: Kevin Osborne, Filer, ID (US)

( * ) Notice: Subject to any disclaimer, the term of this patent is extended or adjusted under 35 U.S.C. 154(b) by 308 days.

(21) Appl. No.: 17/115,427

(22) Filed: Dec. 8, 2020

(65) Prior Publication Data

US 2022/0176207 A1 Jun. 9, 2022

(51) Int. Cl.

| | |
|---|---|
| ***A63B 47/00*** | (2006.01) |
| ***A63B 47/04*** | (2006.01) |
| ***A63B 37/00*** | (2006.01) |
| *A63B 102/32* | (2015.01) |

(52) U.S. Cl.

CPC ..... *A63B 47/04* (2013.01); *A63B 37/0003* (2013.01); *A63B 47/00* (2013.01); *A63B 2047/046* (2013.01); *A63B 2102/32* (2015.10)

(58) Field of Classification Search

CPC ..... A63B 47/04; A63B 37/00

See application file for complete search history.

(56) References Cited

U.S. PATENT DOCUMENTS

| | | | | |
|---|---|---|---|---|
| 3,365,739 | A | 1/1968 | Olinghouse | |
| 5,474,298 | A * | 12/1995 | Lindsay | G01D 5/2033 473/222 |
| 5,524,311 | A | 6/1996 | Crossley | |
| 5,806,122 | A | 9/1998 | Bogle | |
| 6,269,509 | B1 | 8/2001 | Mays | |
| 10,335,643 | B2 | 7/2019 | Arnold | |
| 2005/0188482 | A1* | 9/2005 | Matthews | A63B 47/04 15/21.2 |
| 2008/0060147 | A1* | 3/2008 | Parton | A63B 37/0003 15/21.2 |
| 2019/0308078 | A1 | 10/2019 | Smith | |

FOREIGN PATENT DOCUMENTS

| | | |
|---|---|---|
| WO | WO0148060 | 7/2001 |

* cited by examiner

*Primary Examiner* — Michael D Jennings

(57) ABSTRACT

A portable golf ball scrubber assembly includes a housing. Each of a plurality of straps is coupled to the housing and is extendable around a pole. First and second tracks are positioned within the housing. The second track surrounds the first track. The second track has an opening to receive a golf ball. Each of a plurality of bristles is positioned within the housing to scrub the golf ball. A crank is rotatably coupled to the housing and an arm positioned in the housing engages the crank. The arm travels around the first track and the second track when the cranks is rotated.

14 Claims, 7 Drawing Sheets

PORTABLE GOLF BALL SCRUBBER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to golf ball scrubber devices and more particularly pertains to a new golf ball scrubber device for mounting to a golf cart for scrubbing golf balls during the game of golf.

(2) Description of Related Art Including Information Disclosed Under 37 CFR 1.97 and 1.98

The prior art relates to golf ball scrubber devices including a variety of battery powered golf ball scrubbers for scrubbing golf balls. The prior art discloses a tubular golf ball scrubber.

BRIEF SUMMARY OF THE INVENTION

An embodiment of the disclosure meets the needs presented above by generally comprising a housing that has an entry extending into an interior of the housing for receiving a golf ball and a cleaning solution. A plurality of straps is each coupled to the housing and each of the straps is extendable around a pole on the golf cart for suspending the housing therefrom. A first track is positioned within the housing and a second track is positioned within the housing. The second track is positioned in the housing and the second track surrounds the first track. The second track has an opening to receive the golf ball. A plurality of bristles is each of the bristles is positioned within the housing to scrub the golf ball. A crank is rotatably coupled to the housing and an arm is positioned the housing which engages the crank. The arm travelling around the first track and the second track when the cranks is rotated to scrub the golf balls on the bristles.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
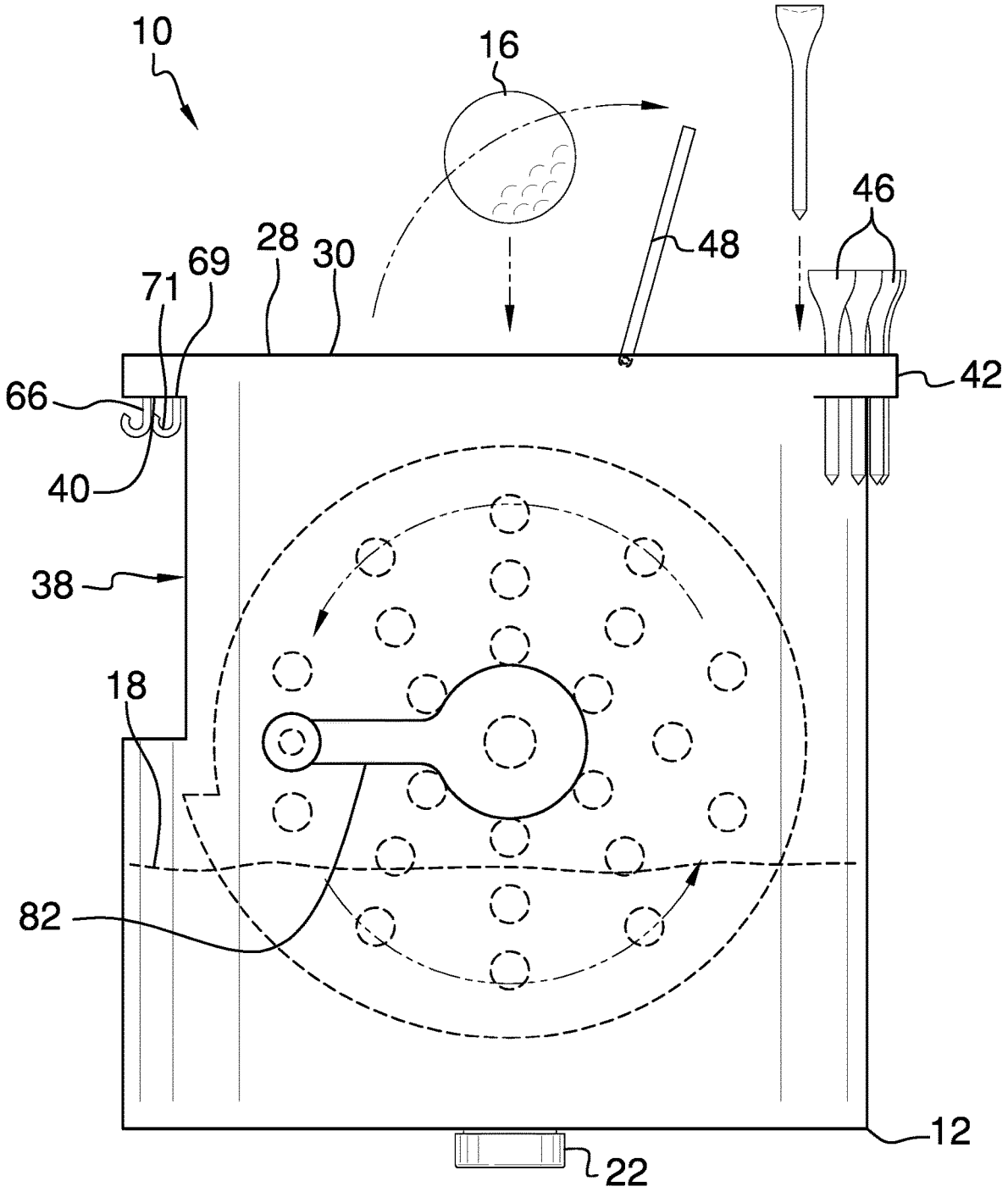
FIG. 1 is a right side phantom view of a portable golf ball scrubber assembly according to an embodiment of the disclosure.
Figure 2:
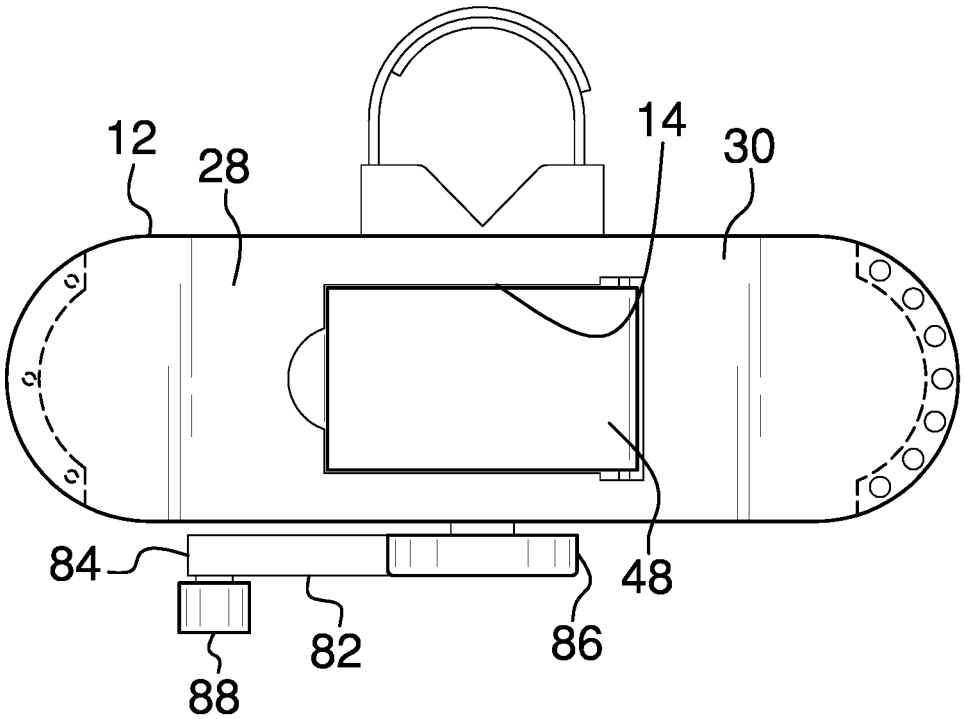
FIG. 2 is a top view of an embodiment of the disclosure.
Figure 3:
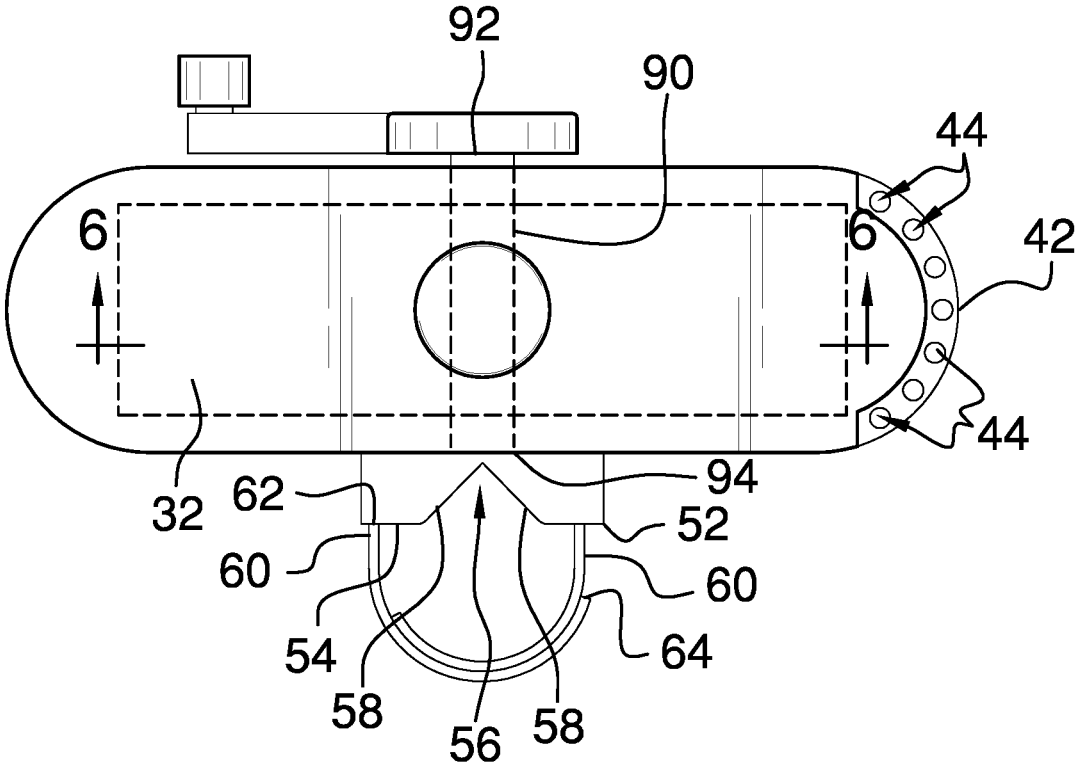
FIG. 3 is a bottom view of an embodiment of the disclosure.
Figure 4:
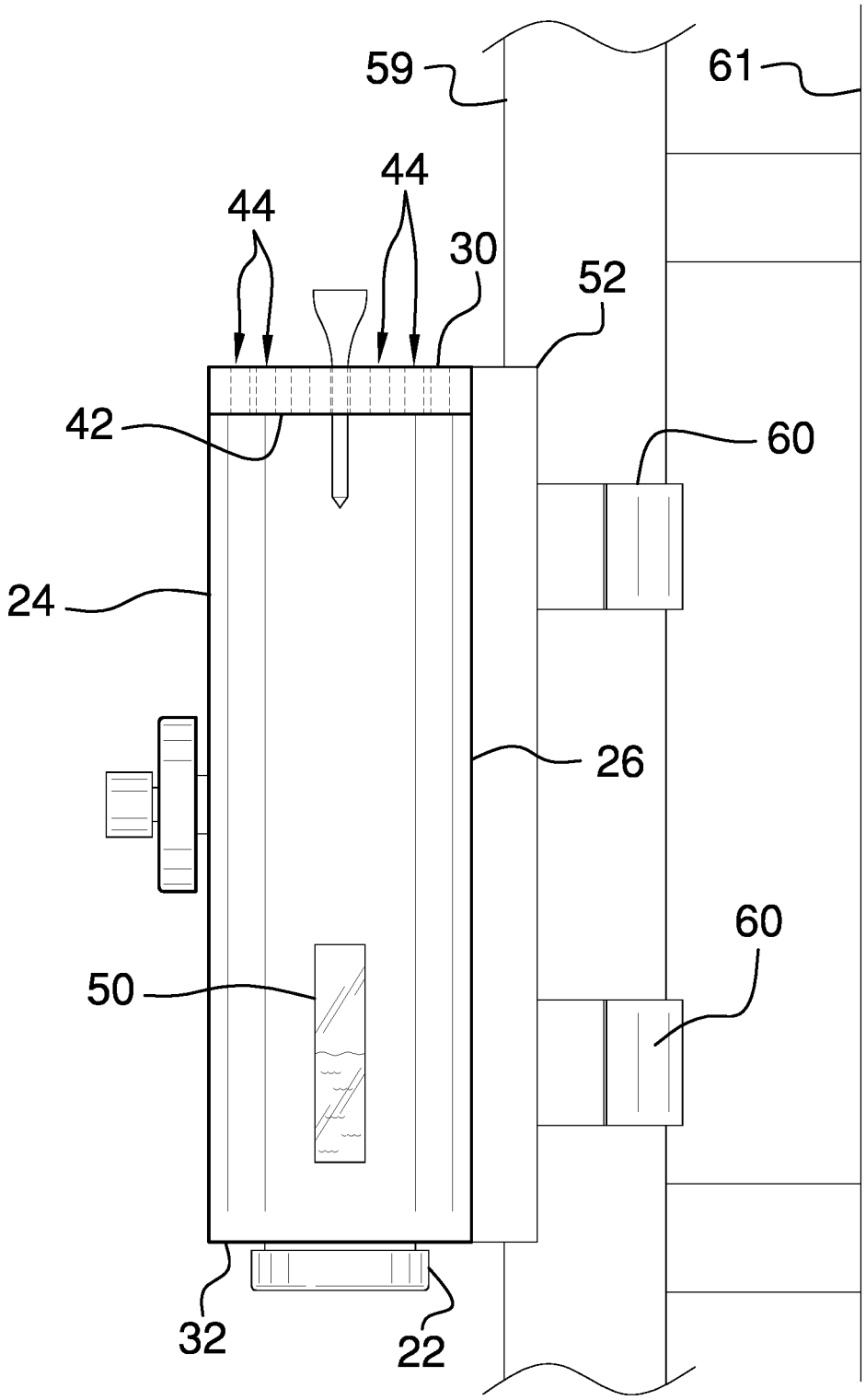
FIG. 4 is a back view of an embodiment of the disclosure.
Figure 5:
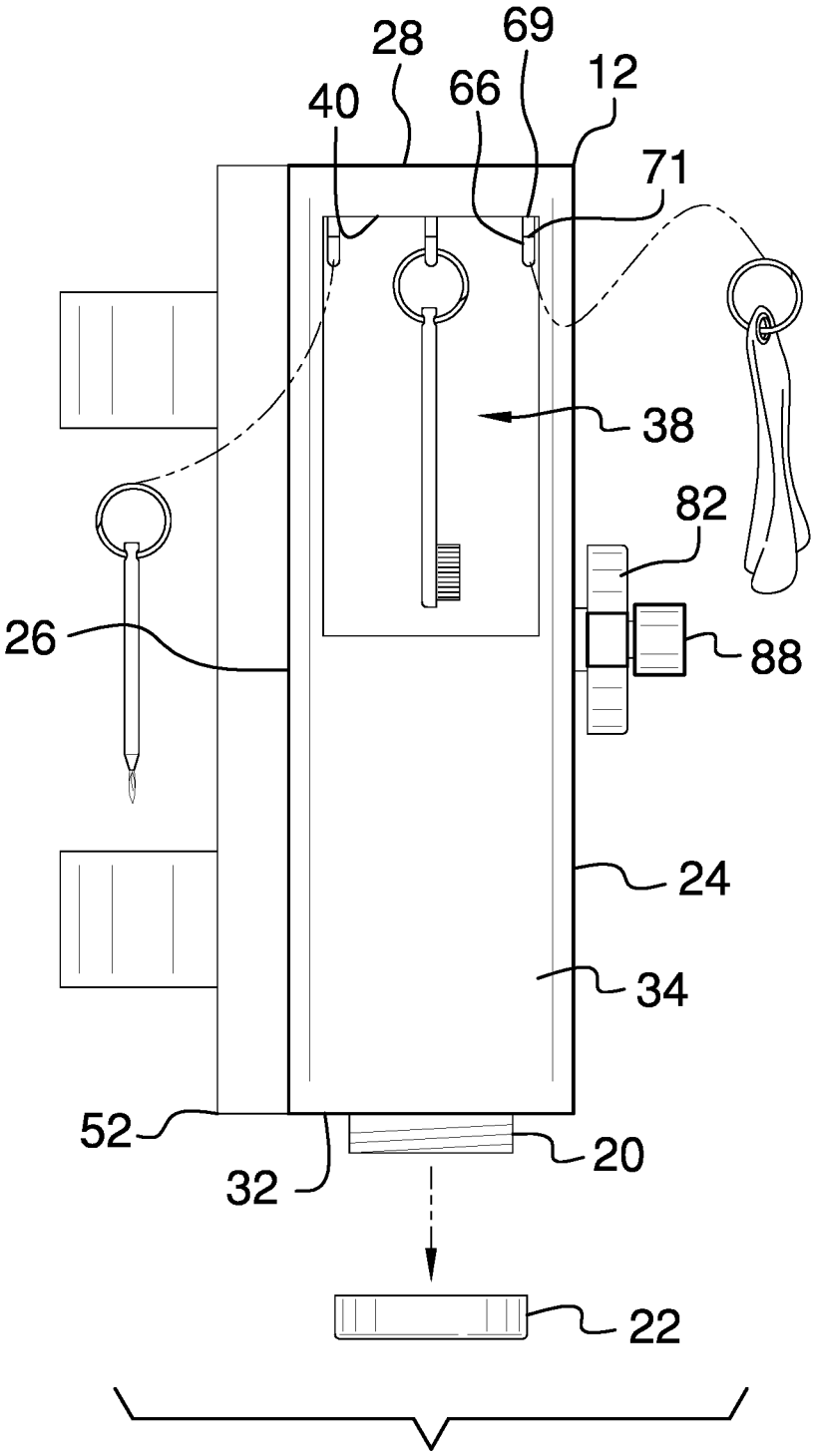
FIG. 5 is a front view of an embodiment of the disclosure.
Figure 6:
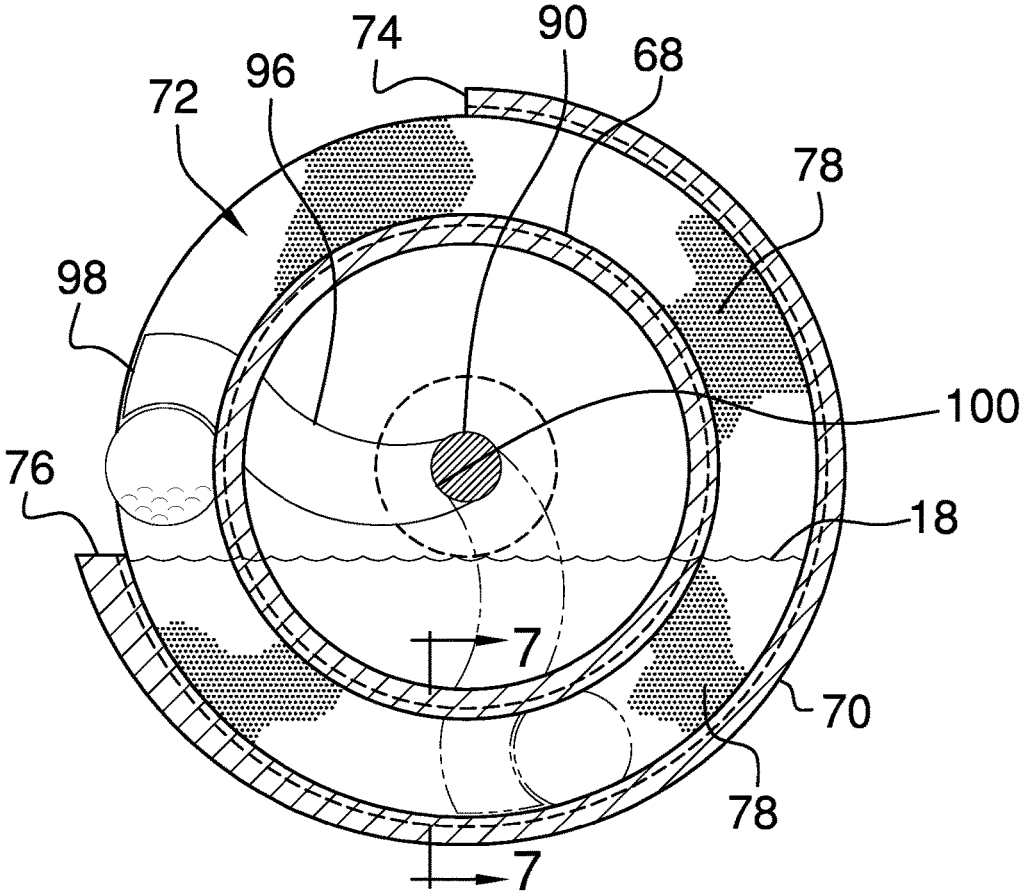
FIG. 6 is a cross sectional view taken along line 6-6 of FIG. 3 of an embodiment of the disclosure.
Figure 7:
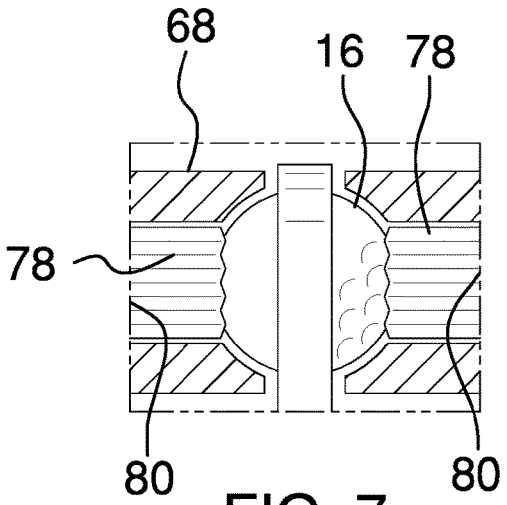
FIG. 7 is a cross sectional view taken along line 7-7 of FIG. 6 of an embodiment of the disclosure.

With reference now to the drawings, and in particular to FIGS. 1 through 8 thereof, a new golf ball scrubber device embodying the principles and concepts of an embodiment of the disclosure and generally designated by the reference numeral 10 will be described.

As best illustrated in FIGS. 1 through 8, the portable golf ball scrubber assembly 10 generally comprises a housing 12 that as an entry 14 extending into an interior of the housing 12. A golf ball 16 can be inserted into the entry 14 and a cleaning solution 18 can be poured through the entry 14 into the housing 12. The housing 12 has a drain 20 extending into the interior of the housing 12 to facilitate the cleaning solution 18 to be drained from the housing 12. A cap 22 is removably attached to the drain 20 for closing the drain 20 to retain the cleaning solution 18 in the housing 12.

The housing 12 has a first lateral wall 24, a second lateral wall 26 and an outer wall 28 extending therebetween, and the outer wall 28 has a top side 30, a bottom side 32, a front side 34 and a back side 36. The entry 14 extends through the top side 30 and the drain 20 extends through the bottom side 32. The front side 34 has a recess 38 extending toward the back side 36 and the recess 38 extends substantially between the top side 30 and the bottom side 32. The recess 38 has an upper bounding surface 40 that is spaced from the top side 30 and the top side 30 has a lip 42 extending beyond the back side 36 of the outer wall 28. The lip 42 has a plurality of holes 44 each extending therethrough to receive a golf tee 46 for storage. A door 48 is hingedly coupled to the top side 30 for opening 72 and closing the entry 14 and a window 50 is integrated into the back side 36 to facilitate the level of the cleaning solution 18 to be visible through the window 50.

A wedge 52 is coupled to the second lateral wall 26 of the housing 12 and the wedge 52 has a distal surface 54 with respect to the second lateral wall 26. The distal surface 54 has a channel 56 extending toward the second lateral wall 26 and the channel 56 has a pair of bounding surfaces 58 that intersect at a right angle. In this way the channel 56 can accommodate a pole 59 on a golf cart 61. A plurality of straps 60 is provided and each of the straps 60 is coupled to the wedge 52. Each of the straps 60 is matable to each other such that each of the straps 60 can extend around a pole 59 on the golf cart 61 for suspending the housing 12 therefrom. In this way the housing 12 is constantly accessible to a user while the user is golfing. Each of the straps 60 has a coupled end 62 that is coupled to the distal surface 54 of the wedge 52. Additionally, each of the straps 60 has a free end 64 and the free end 64 of each of the straps 60 is releasably matable to each other.

A plurality of hooks 66 is provided and each of the hooks 66 is coupled to and extends downwardly from the upper bounding surface 40 of the recess 38. In this way each of the hooks 66 can have a cleaning tool 67 suspended thereon for cleaning a face of a golf club. The cleaning tools 67 might include a club brush, a towel and a pick for removing debris from grooves in the face of the golf club. Each of the hooks 66 has a first end 69 and a second end 71. The first end 69 of each of the hooks 66 is coupled to the upper bounding surface 40 and each of the hooks 66 is curved adjacent to the second end 76 of the hooks 66 such that the second end 71 of the hooks 66 is directed toward the upper bounding surface 40.

A first track 68 is positioned within the housing 12 and the first track 68 is continuously arcuate such that the first track 68 forms a closed loop. The first track 68 extends between the first lateral wall 24 and the second lateral wall 26, and the first track 68 is centrally positioned in the housing 12. A second track 70 is positioned within the housing 12 and the second track 70 is curved such that the second track 70 forms an open loop. The second track 70 extends around the first track 68 having an opening 72 in the second track 70 being aligned with the entry 14 in the housing 12. In this way the opening 72 can receive the golf ball 16. The second track 70 extends between the first lateral wall 24 and the second lateral wall 26. Additionally, the second track 70 has a first end 74 and a second end 76, and the first end 74 of the second track 70 is spaced from the second end 76 of the second track 70 to define the opening 72. Each of the first track 68 and the second track 70 has an inwardly facing surface 75 that is concavely arcuate to conform to curvature of the golf ball 16.

A plurality of bristles 78 is provided and each of the bristles 78 is positioned within the housing 12. Each of the bristles 78 is aligned with the first track 68 and the second track 70 such that the plurality of bristles 78 can scrub the golf ball 16. Each of the bristles 78 is coupled to an inside surface 80 of a respective one of the first lateral wall 24 and the second lateral wall 26 of the housing 12. A crank 82 is rotatably coupled to the housing 12 and the crank 82 can be rotated by a user. The crank 82 has a first end 84 and a second end 86, and the crank 82 has a knob 88 that is rotatably coupled to and extends laterally away from the crank 82 such that the knob 88 can be gripped. A shaft 90 is included that has a first end 92 and a second end 94, and the first end 92 of the shaft 90 is coupled to the crank 82 at a point located adjacent to the second end 86 of the shaft 90. The shaft 90 is oriented perpendicular to the crank 82 having the shaft 90 extending through the second lateral wall 26 of the housing 12 at a point that is centrally located in the closed loop formed by the first track 68.

An arm 96 is included that has a primary end 98 and a secondary end 100, and the arm 96 is coupled to the shaft 90 at a point located adjacent to the secondary end 100. Additionally, the arm 96 extends along a perpendicular axis with respect to an axis extending through the first end 92 and the second end 94 of the shaft 90. The arm 96 is positioned between the first track 68 and the second track 70 and the arm 96 undulates between the primary end 98 and the secondary end 100 to conform to curvature of the golf ball 16. The arm 96 travels around the first track 68 and the second track 70 when the crank 82 is rotated such that the arm 96 scrubs the golf ball 16 on the bristles 78.

Figure 8:
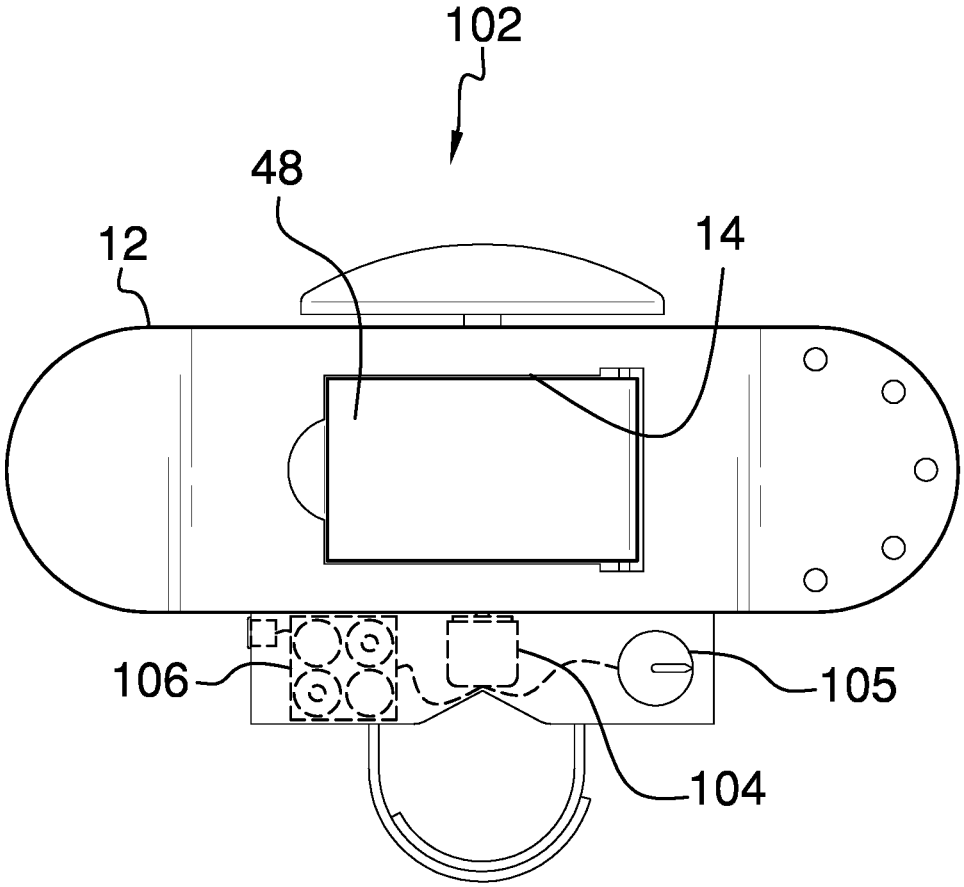
FIG. 8 is a top phantom view of an alternative embodiment of the disclosure.

In an alternative embodiment 102 as is most clearly shown in FIG. 8, a motor 104 is integrated into the housing 12. The motor 104 engages the first end 74 of the shaft 90 and the motor rotates the shaft 90 when the motor 104 is turned on. The motor 104 may comprise an electric motor or the like. Continuing in the alternative embodiment 102, a power switch 105 is movably coupled to the housing 12 and the power switch 105 is electrically coupled to the motor 104 for turning the motor 104 on and off. Continuing in the alternative embodiment 102, a power supply 106 is integrated into the housing 12, the power supply 106 is electrically coupled to the power switch 105 and the power supply 106 comprises at least one battery.

In use, the housing 12 is mounted to the pole 59 on the golf cart 61 and the housing 12 is filled to a desired level with the cleaning solution 18. The golf ball 16 is dropped into the entry 14, the door 48 is closed and the crank 82 is cranked to scrub the golf ball 16. The golf ball 16 is returned to the entry 14 for retrieval from the housing 12. In this way the golf ball 16 can be cleaned at any location on a golf course and at any time. Additionally, the cleaning tools can be employed for cleaning the face of the golf clubs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable golf ball scrubber assembly for scrubbing a golf ball on a golf cart, said assembly comprising:

a housing having an entry extending into an interior of said housing wherein said entry is configured to have a golf ball inserted therein and to facilitate a cleaning solution to be poured into said housing, said housing having a drain extending into said interior of said housing wherein said drain is configured to facilitate the cleaning solution to be drained from said housing;

a plurality of straps, each of said straps being coupled to said housing, each of said straps being matable to each other wherein each of said straps is configured to extend around a pole on the golf cart for suspending said housing therefrom;

a first track being positioned within said housing, said first track being continuously arcuate such that said first track forms a closed loop;

a second track being positioned within said housing, said second track being curved such that said second track forms an open loop, said second track extending around said first track having an opening in said second track being aligned with said entry in said housing wherein said opening is configured to receive the golf ball;

a plurality of bristles, each of said bristles being positioned within said housing, each of said bristles being aligned with each of said first track and said second track wherein said plurality of bristles is configured to scrub the golf ball;

a crank being rotatably coupled to said housing wherein said crank is configured to be rotated by a user; and an arm being positioned in said housing, said arm engaging said crank, said arm travelling around said first track and said second track when said cranks is rotated wherein said arm is configured to scrub the golf balls on said bristles.

2. The assembly according to claim 1, wherein said housing has a first lateral wall, a second lateral wall and an outer wall extending therebetween, said outer wall having a top side, a bottom side, a front side and a back side, said entry extending through said top side, said drain extending through said bottom side.

3. The assembly according to claim 2, wherein said front side has a recess extending toward said back side, said recess extending substantially between said top side and said bottom side, said recess having an upper bounding surface being spaced from said top side.

4. The assembly according to claim 3, further comprising a plurality of hooks, each of said hooks being coupled to and extending downwardly from said upper bounding surface of said recess wherein each of said hooks is configured to have cleaning tools suspended thereon for cleaning a face of a golf club.

5. The assembly according to claim 2, wherein said top side has a lip extending beyond said back side of said outer wall, said lip having a plurality of holes each extending therethrough wherein each of holes is configured to receive a golf tee for storage.

6. The assembly according to claim 2, wherein said first track extends between said first lateral wall and said second lateral wall, said first track being centrally positioned in said housing.

7. The assembly according to claim 2, wherein said second track has a first end and a second end, said first end of said second track being spaced from said second end of said second track to define said opening, said second track extending between said first lateral wall and said second lateral wall.

8. The assembly according to claim 2, wherein each of said bristles is coupled to an inside surface of a respective one of said first lateral wall and said second lateral wall of said housing.

9. The assembly according to claim 1, wherein said crank has a first end and a second end, said crank having a knob being rotatably coupled to and extending laterally away from said crank wherein said knob is configured to be gripped.

10. The assembly according to claim 9, wherein:

said housing has a first lateral wall and a second lateral wall; and said assembly includes a shaft being having a first end and a second end, said first end being coupled to said crank at a point located adjacent to said second end, said shall being oriented perpendicular to said crank having said shaft extending through said second lateral wall of said housing at a point being centrally located in said closed loop formed by said first tracks.

11. The assembly according to claim 10, wherein said arm has a primary end and a secondary end, said arm being coupled to said second end of said shaft at a point located adjacent to said secondary end such that said arm extends along a perpendicular axis with respect to an axis extending through said first end and said second end of said shaft, said arm being positioned between said first track and said second track, said arm undulating between said primary end and said secondary end wherein said arm is configured to conform to curvature of the golf ball. . A portable golf ball scrubber assembly for scrubbing a golf ball on a golf cart, said assembly comprising:

a housing having an entry extending into an interior of said housing wherein said entry is configured to have a golf ball inserted therein and to facilitate a cleaning solution to be poured into said housing, said housing having a drain extending into said interior of said housing wherein said drain is configured to facilitate the cleaning solution to be drained from said housing, said housing having a first lateral wall, a second lateral wall and an outer wall extending therebetween, said outer wall having a top side, a bottom side; a front side and a back side, said entry extending through said top side, said drain extending through said bottom side, said front side having a recess extending toward said back side, said recess extending substantially between said top side and said bottom side, said recess having an upper bounding surface being spaced from said top side, said top side having a lip extending beyond said back side of said outer wall, said lip having a plurality of holes each extending therethrough wherein each of holes is configured to receive a golf tee for storage;

a plurality of straps, each of said straps being coupled to said housing, each of said straps being matable to each other wherein each of said straps is configured to extend around a pole on the golf cart for suspending said housing therefrom, each of said straps having a coupled end being coupled to said second lateral wall of said housing, each of said straps having a free end, said free end of each of said straps being releasably matable to each other;

a plurality of hooks, each of said hooks being coupled to and extending downwardly from said upper bounding surface of said recess wherein each of said hooks is configured to have cleaning tools suspended thereon for cleaning a face of a golf club;

a first track being positioned within said housing, said first track being continuously arcuate such that said first track forms a closed loop; said first track extending between said first lateral wall and said second lateral wall, said first track being centrally positioned in said housing;

a second track being positioned within said housing, said second track being curved such that said second track forms an open loop, said second track extending around said first track having an opening in said second track being aligned with said entry in said housing wherein said opening is configured to receive the golf ball, said second track extending between said first lateral wall and said second lateral wall, said second track having a first end and a second end, said first end of said second track being spaced from said second end of said second track to define said opening;

a plurality of bristles, each of said bristles being positioned within said housing, each of said bristles being aligned with said tracks wherein said plurality of bristles is configured to scrub the golf ball, each of said bristles being coupled to an inside surface of a respective one of said first lateral wall and said second lateral wall of said housing;

a crank being rotatably coupled to said housing wherein said crank is configured to be rotated by a user, said crank having a first end and a second end, said crank having a knob being rotatably coupled to and extending laterally away from said crank wherein said knob is configured to be gripped;

a shaft being having a first end and a second end, said first end being coupled to said crank at a point located adjacent to said second end, said shaft being oriented perpendicular to said crank having said shaft extending through said second lateral wall of said housing at a point being centrally located in said closed loop formed by said first track;

an arm having a primary end and a secondary end, said arm being coupled to said second end of said shaft at a point located adjacent to said secondary end such that said arm extends along a perpendicular axis with respect to an axis extending through said first end and said second end of said shaft, said arm being positioned between said first track and said second track, said arm undulating between said primary end and said secondary end wherein said arm is configured to conform to curvature of the golf said arms travelling around said first track and said second track when said cranks is rotates wherein said arm is configured to scrub the golf balls on said bristles.

12. The assembly according to claim , further comprising a motor being integrated into said housing, said motor engaging said first end of said shaft, said motor rotating said shaft when said motor is turned on.

13. The assembly according to claim 12, further comprising a power switch being movably coupled to said housing, said power switch being electrically coupled to said motor for turning said motor on and off.

14. The assembly according to claim 13, further comprising a power supply being integrated into said housing, said power supply being electrically coupled to said power switch, said power supply comprising at least one battery.

* * * * *